United States Patent [19]

Bryce

[11] 4,300,696

[45] Nov. 17, 1981

[54] LITTER BIN

[76] Inventor: Ian R. Bryce, Flat 2, 15 Rockley Rd., South Yarra, 3141, Melbourne, Australia

[21] Appl. No.: 151,454

[22] Filed: May 19, 1980

[30] Foreign Application Priority Data

May 18, 1979 [AU] Australia ..... PD8861

[51] Int. Cl.[3] ..... B65D 49/02

[52] U.S. Cl. ..... 220/18; 220/1 T; 220/262; 248/133

[58] Field of Search ..... 220/18, 1 T, 262, 263; 248/128, 133, 143, DIG. 7; 232/1 E, 65

[56] References Cited

U.S. PATENT DOCUMENTS 1,213,588 1/1917 Cohen ..... 220/18 X

*Primary Examiner*—George T. Hall

*Attorney, Agent, or Firm*—Lane, Aitken, Kice & Kananen

[57] ABSTRACT

A litter bin comprising a heavy base member adapted to rest on the ground, a litter container mounted on said base member through an annular rubber bush and a central bolt connecting the container to the base member and passing through the bush, an upwardly extending support pole secured to the base member, an arm pivotally attached to the top of the pole and having a lid attached to the end thereof at a position which normally is in overlying relationship with the litter container an actuating mechanism associated with the container whereby the container may be tilted in substantially any direction through said rubber bush connection from its position under said lid to a position in which it is exposed for the receipt of litter or refuse.

20 Claims, 3 Drawing Figures

LITTER BIN

BACKGROUND OF INVENTION

This invention relates to Litter Bins, and more particularly to public Litter Bins, although the invention is equally applicable to Litter Bins for use within the home, office or factory.

The many existing designs of public Litter Bins suffer from various disadvantages.

In bins with no lid, the litter may be visually offensive, it may be blown out by wind, rain may enter and hasten decay thereby creating offensive odours, and cats dogs and birds may scatter the litter therein.

In bits with hand operated lids or flaps, operation is inconvenient when approaching the bin from some directions, and when unwrapping an article or peeling fruit or the like, a hand may not be available to hold the lid open. In addition, the lid or flap is usually soiled with litter and there is therefore the risk of soiling and contaminating the hand and hence the food being eaten.

In bins with foot operated lids or flaps, one must approach the bin from a particular direction, complex mechanical linkages are often required, and no design suitable for public use has been found.

Bins with partly open lids suffer to some degree the disadvantages of the open type and also restrict access when depositing litter.

The object of the invention is to provide a Litter Bin which at least substantially overcomes a majority of the above disadvantages.

SUMMARY OF THE INVENTION

The invention therefore provides a Litter Bin comprising a base member, a litter container mounted on said base member through a connection means, an upwardly extending support means secured to said base member, a lid directly or indirectly carried by said support means and normally substantially covering said container, and actuating means associated with said container whereby the container may be tilted through said connection means from its position under said lid to a position in which it is exposed for the receipt of litter or refuse.

In a preferred form of the invention, the connection means is a universal connection which allows tilting movement of said container in any direction.

In a particularly preferred form of the invention, said actuating means extends around substantially the entire periphery of said container whereby actuation from substantially any position around the container is possible. Preferably said actuating means is located in a position which enables foot operation of said bin.

Other particularly preferred features of the invention will be evident from the following description of preferred embodiments of the invention.

Figure 1:
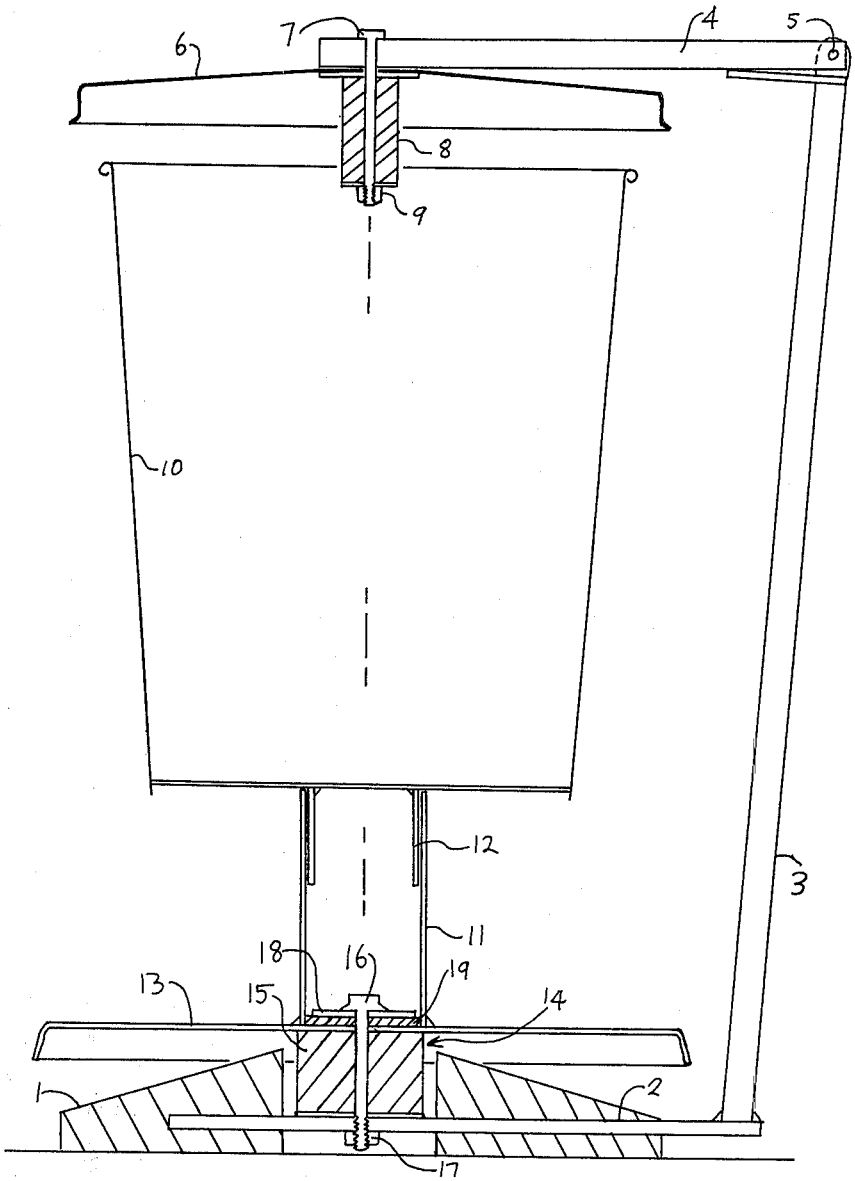
FIG. 1 is a sectional elevation of a public Litter Bin embodying the invention.
Figure 2:
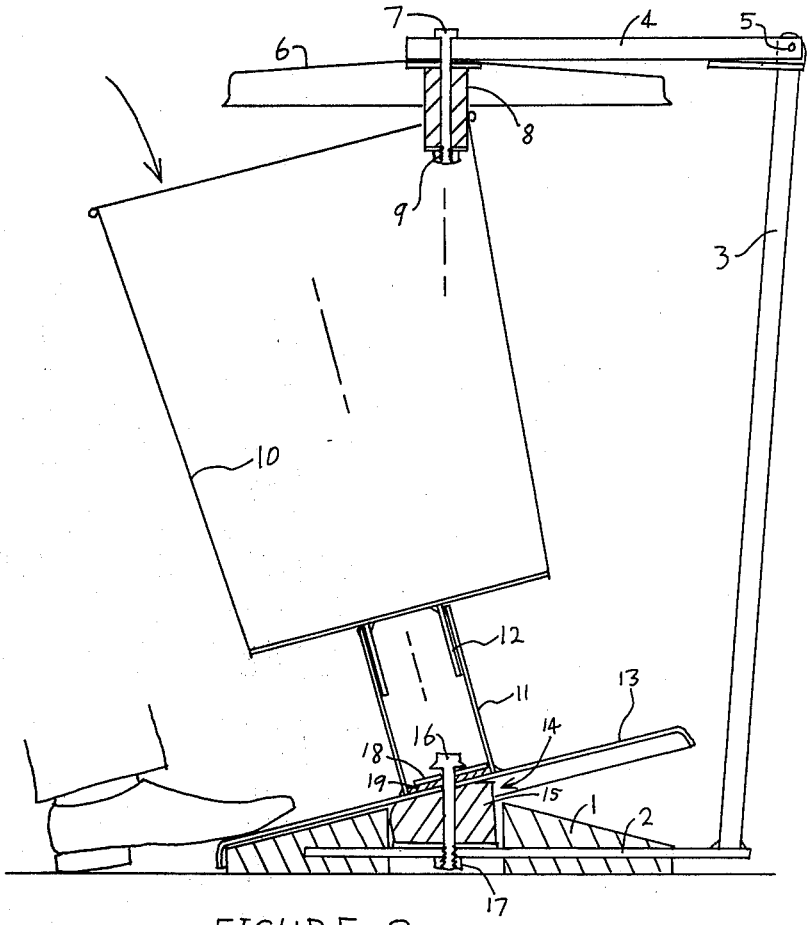
FIG. 2 is a sectional elevation of the Bin of FIG. 1 when tilted.

Referring firstly to FIGS. 1 and 2 of the drawings, a public Litter Bin embodying the invention will be seen to comprise an annular, generally frusto-conical concrete base member 1 in which a steel plate 2 is cast in-situ to extend diametrically of the base member 1. A vertically extending support pipe 3 is welded or otherwise secured to the exposed end of the plate 2. An arm 4 is attached to the upper end of the pipe 3 by a pivot pin 5 and supports a lid 6 at its free end by means of a bolt 7 passing through the arm 4 and through a tubular rubber buffer 8 which is in turn secured in place by a nut 9.

A container 10 for receiving litter is supported by a central tubular column 11 through a short tube 12 which is secured to the base of container 10 and which is received within the upper end of the column 11. A circular bin actuating plate 13 is welded to the lower end of column 11 and the assembly of the plate 13, column 11 and container 10 is secured to the base member through a deformable and restorative connection 14 which comprises a rubber bush 15 interposed between the actuating plate 13 and the plate 2 in the base member 1, and an attaching bolt 16 which passes loosely through central holes in the actuating plate 13 and the plate 2 and is held in place by a nut 17. The enlarged head of the bolt 16 bears on a metal washer 18 which in turn bears on a rubber washer 19 engaging the actuating plate 13.

In use, a person wishing to deposit litter in the bin, simply steps on the actuating plate 13, as shown in FIG. 2, and the container 10 may be tilted until the plate 13 engages the inclined surface of the base member 1 and or until the rim of the container 10 engages the buffer 8 extending from the lid 6. When the operator's foot is removed, the resilience of the bush 14 restores the container 10 to the position shown in FIG. 1. Shearing forces between the rubber washer 19, the plate 13 and the washer 18, which are adjustable by the nut 17, assist in damping oscillations of the container 10 as it returns to its covered position under the lid 6. As mentioned above, the bolt 16 has an enlarged head and accordingly a predetermined force is required before tilting of the container 10 is achieved and this reduces the extent to which the bin will be deflected by the wind or by animals.

It will be appreciated firstly that foot operation enables the user to expose the container 10 from its position under the lid 6 without handling the bin or the lid in any way. Similarly, the operation of the bin may be achieved from virtually any direction, with the exception of the small region occupied by the support pipe 3. Thus, by the arrangement shown in the preferred embodiment, each of the disadvantages of the prior art is overcome. The bin is of course easily emptied by pivoting the arm 4 away from the container 10 and lifting the container 10 and short tube 12 free from tubular column 11.

Figure 3:
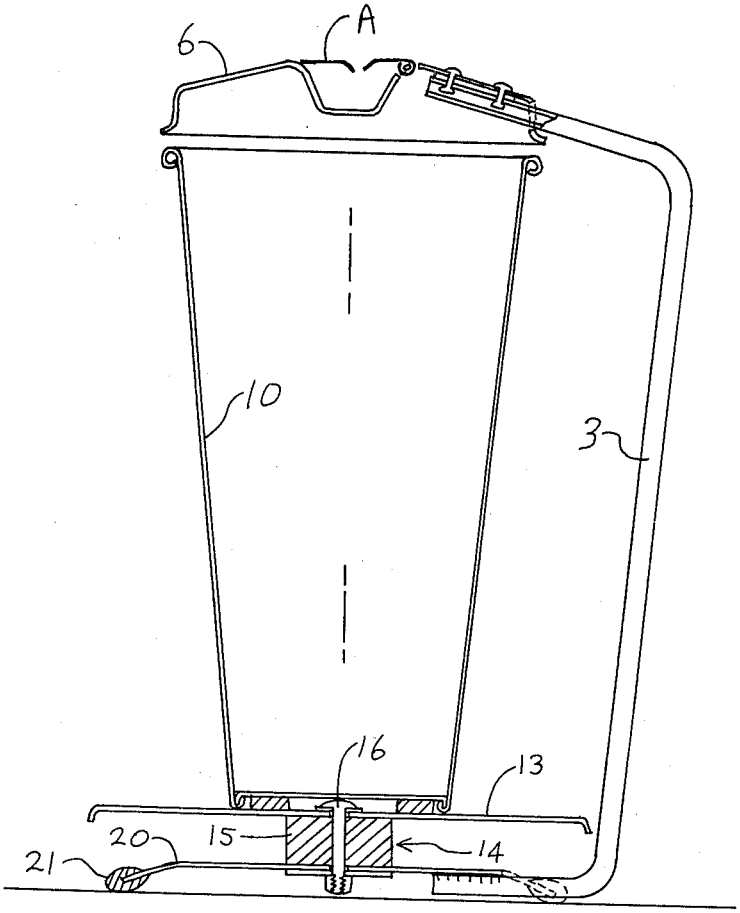
FIG. 3 is a sectional elevation of a Litter Bin suitable for home use.

Referring now to FIG. 3 of the drawings, a modified embodiment suitable for use within the home, office or factory, is shown. In this embodiment, the base member 1 is replaced by a shaped sheet metal base member 20 having a rubber edging member 21 which engages the floor and restricts sliding movement of the base as the bin is actuated in the same manner as described above. It will be noted that the rubber bush is positioned between the base member 20 and the actuating plate which is secured directly beneath the container. In this case emptying is achieved by lifting the bin by means of the support pipe 3 whereupon the bin tilts away from the lid under the action of gravity and whereupon the contents of the bin are discharged. In this embodiment, the rubber bush need not have the same degree of resilience as the bush 15 in the previous embodiment since the bin is not subjected to winds or to animal activities.

In each of the above embodiments, the rubber bush 15 may be replaced by any suitable resilient member, for an example a compression spring. Similarly, the joint 14 may comprise some form of ball joint to enable pivotal movement in ay direction with the restorative force being provided by some suitable resilient means, for example one or more springs or rubber bushings, or by the action of gravity on the container 10. Similarly, in certain situations, the actuating plate 13 may be replaced by some other form of actuating means which may be hand, knee or foot operated. Indeed, in suitable circumstances the actuating means may comprise a handle secured to the container 10. For obvious reasons this arrangement is not as preferred as the embodiments described above.

What I claim is:

1. A litter bin comprising a base member, a litter container mounted on said base member through a universal connection means, an upwardly extending support means secured to said base member, a lid directly or indirectly carried by said support means and normally substantially covering said litter container, and activating means associated with said container whereby the container may be tilted in substantially any direction through said connection means from its position under said lid to a position in wich it is exposed for the receipt of litter or refuse.

2. The litter bin of claim 1, wherein said actuating means extends around substantially the entire periphery of said container whereby activation from substantially any position around said container is possible.

3. The litter bin of claim 1, 2, wherein said connection means comprises a resilient member held between said container and said base member such that when said container is released from its tilted position, said resilient member restores said container to its position under said lid.

4. The litter bin of claim 3, wherein said resilient member comprises a rubber bush, said connection means including a central bolt connecting the container to the base member and passing through said bush.

5. The litter bin of claim, 1 or 2 wherein said actuating member extends outwardly relative to said container from a position at or below the base of the container whereby foot actuation of the bin is facilitated.

6. The litter bin of claim 5, wherein said container is mounted on a central supporting column to the lower end of which said actuating means is attached.

7. The litter bin of claim 1 or 2 wherein said base member is a heavy casting having an inclined upper surface.

8. The litter bin of claim 3, wherein said actuating member extends outwardly relative to said container from a position at or below the base of the container whereby foot actuation of the bin is facilitated.

9. The litter bin of claim 4, wherein said actuating member extends outwardly relative to said container from a position at or below the base of the container whereby foot actuation of the bin is facilitated.

10. The litter bin of claim 8, wherein said container is mounted on a central supporting column to the lower end of which said actuating means is attached.

11. The litter bin of claim 9, wherein said container is mounted on a central supporting column to the lower end of which said actuating means is attached.

12. The litter bin of claim 3, wherein said base member is a heavy casting having an inclined upper surface.

13. The litter bin of claim 4, wherein said base member is a heavy casting having an inclined upper surface.

14. The litter bin of claim 5, wherein said base member is a heavy casting having an inclined upper surface.

15. The litter bin of claim 6, wherein said base member is a heavy casting having an inclined upper surface.

16. The litter bin of claim 7, wherein said base member is a heavy casting having an inclined upper surface.

17. The litter bin of claim 8, wherein said base member is a heavy casting having an inclined upper surface.

18. The litter bin of claim 9, wherein said base member is a heavy casting having an inclined upper surface.

19. The litter bin of claim 10, wherein said base member is a heavy casting having an inclined upper surface.

20. The litter bin of claim 11, wherein said base member is a heavy casting having an inclined upper surface.

* * * * *